United States Patent [19]

Hultquist

[11] 4,429,562

[45] Feb. 7, 1984

[54] AUTO BODY DENT REMOVING PULLER AND ANCHOR

[76] Inventor: John V. Hultquist, 10500 Westminster St., Apt. #13, Garden Grove, Calif. 92643

[21] Appl. No.: 251,952

[22] Filed: Apr. 7, 1981

[51] Int. Cl.[3] ..... B21D 1/12

[52] U.S. Cl. ..... 72/479; 72/705; 294/97

[58] Field of Search ..... 72/479, 705; 294/86.14, 294/86.16, 97

[56] References Cited

U.S. PATENT DOCUMENTS

| | | | |
|---|---|---|---|
| 832,920 | 10/1906 | Morrow | 294/86.14 |
| 2,584,124 | 2/1952 | Gustafson | 294/97 |
| 2,789,859 | 4/1957 | Woellner | 294/97 |
| 3,307,871 | 3/1967 | Russell et al. | 294/97 |
| 3,577,881 | 5/1971 | Markovics | 72/705 |
| 4,235,090 | 11/1980 | Wightman et al. | 72/479 |

*Primary Examiner*—Lowell A. Larson

*Attorney, Agent, or Firm*—Dean P. Edmundson

[57] ABSTRACT

This auto body dent removing puller and anchor may be inserted through a drilled hole or existing hole in the body of automobiles or other vehicles. The hole having to be only as large as the modified cylinder shaped part of the tool. It can be made in various lengths and diameters. Once inserted this uniquely modified cylinder shaped portion may be tipped by a rod attached to the outside of the tool and to the cylinder allowing a flattened V-shaped surface area to abut against the inside of the material for the purpose of pulling a damaged area out with common pulling devices or with an impacting device such as a slide hammer. Once the damaged area is pulled out it may be removed from the hole easily by the same rod it was tipped with after being inserted.

7 Claims, 10 Drawing Figures

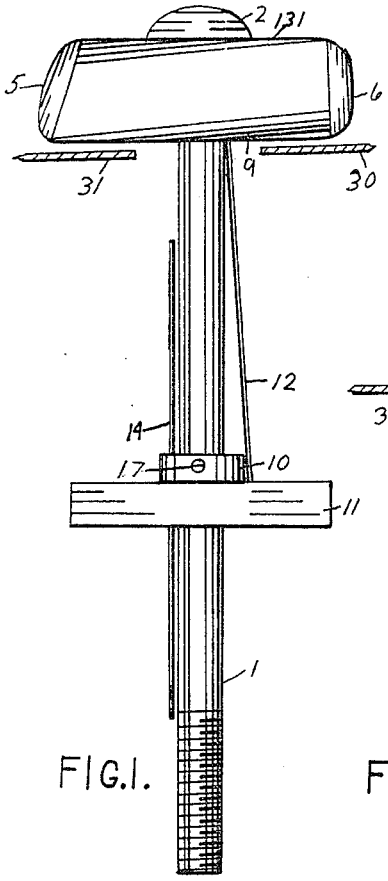
FIG.1.
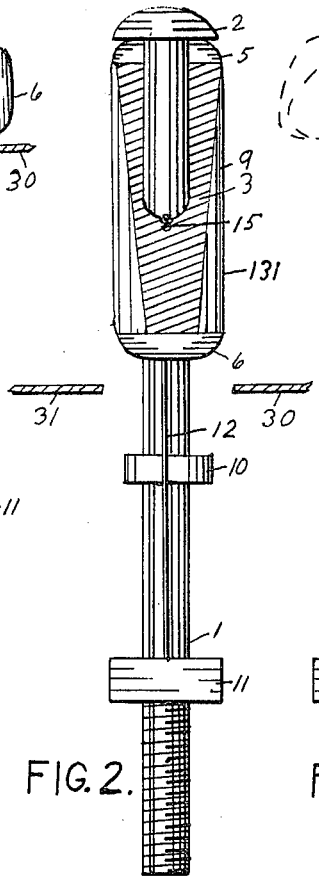
FIG.2.
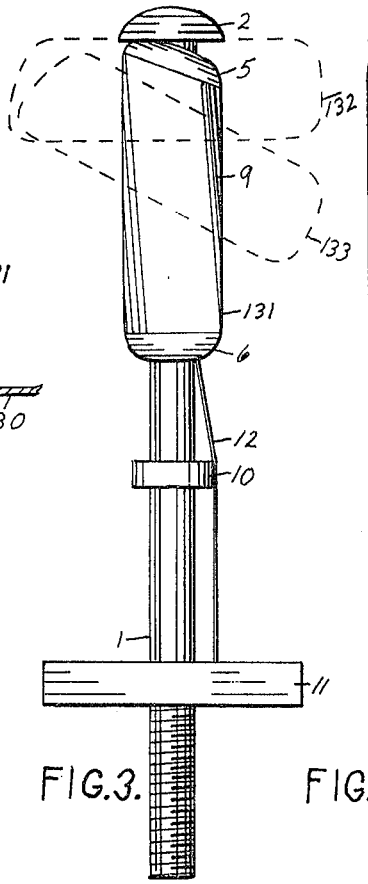
FIG.3.
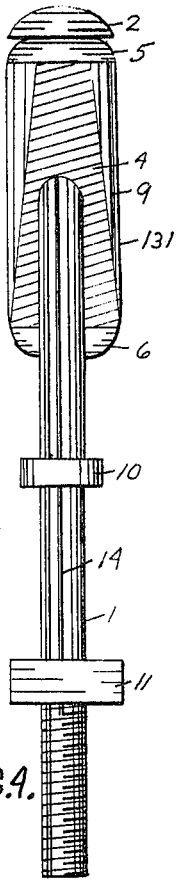
FIG.4.
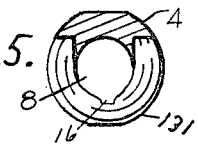
FIG.5.
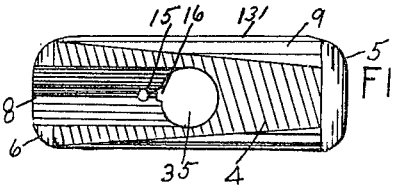
FIG.6.
FIG.7.
FIG.8.
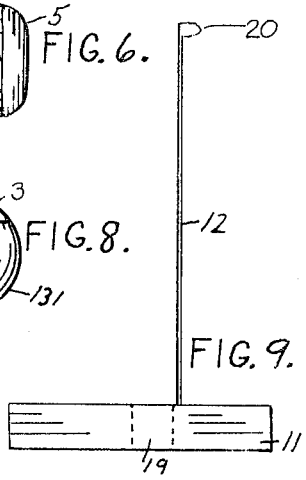
FIG.9.
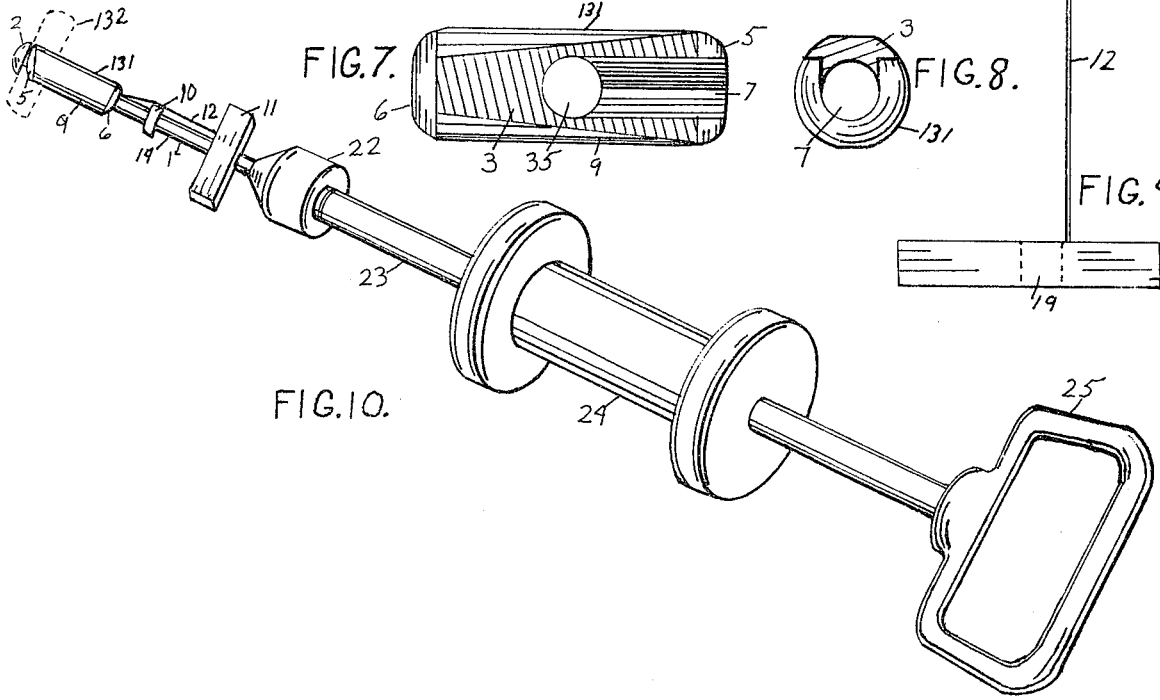
FIG.10.

AUTO BODY DENT REMOVING PULLER AND ANCHOR

BRIEF SUMMARY OF THE INVENTION

In the art of auto body repairing internal pulling and impacting devices are used to pull out damaged areas when access is limited due to the boxed in type structure of some part of the vehicle. Some of the devices used for this type of repair along with a pulling or impacting device are U.S. Pat. Nos. 832,920, 2,470,498, 3,332,118, 3,641,805 and 4,122,699. This invention differs from the foregoing inventions as it allows the operator to insert this modified cylinder shaped tool into a drilled hole or an existing hole. Once inserted the tool is tipped by a handle or lever on the outside portion of the shank and allowing the V-shaped flat surface to abut against the inside of the damaged area so a pulling or impacting pressure can be applied to the damaged area forcing it back into its original shape. Once the necessary pulling or impacting hammering is completed it may be easily removed by simply pulling back on the handle or lever. Thereafter the hole is merely filled by the use of plastic body fillers or welding as necessary. This tool may have different diameters and lengths of the cylinder which allows it to be used in many different applications as a puller and an anchor. By using tool steel and having no center pin this tool can be made to withstand great pressure and also the V-shaped flat surface reduces the amount of probable tearing of the metal when pulling or impacting devices are used.

BRIEF INVENTION DESCRIPTION

The purpose of the invention is to allow access for a modified cylinder shaped object to be inserted through a drilled round hole or existing hole where access is prohibited by a boxed in structure and after the cylinder is inserted through the hole the cylinder is allowed to be tipped at an angle or perpendicular angle from the shaft that the slotted cylinder surrounds after being inserted. This, therefore, allows the shank that the slotted cylinder is attached to and in an angular or perpendicular position to be pulled or drawn back by a pulling device such as a come-a-long or a reversed acting impacting tool such as a common device shown as a slide hammer. This tool would be very useful in repairing damaged areas on automobiles in handling of other objects or materials where access is prohibited from the inside of a boxed in object. The tool is as easily removed as it is inserted. It is a slotted cylinder shaped object surrounding a shaft that has a head similar to a common bolt. The cylinder being slotted from opposite ends on opposite sides. The depth of the slots being one-half the thickness of the diameter of the cylinder plus the one-half diameter of the shaft it surrounds. Both ends of the cylinder are rounded and one end angled at the end closest to the head of the shaft for the purpose of aiding in tipping the cylinder. The rounded end makes simple removal of the cylinder back out of the same hole in the material it was inserted. The cylinder is also tapered from opposite directions, the wider portion of the taper starting at the ends that are slotted and ending at the opposite ends, therefore, this leaves a V-shaped flat surface to be forced against the material that it has been inserted through, thus allowing a backward pressure to be used on the shank and the slotted cylinder that has been tipped into a perpendicular position to the shank. After inserting the tool through the hole a rod attached to the cylinder wall is pushed towards the head of the shaft turning the cylinder in a perpendicular position. The removal of the tool is simply made by pulling back on the rod that tipped the cylinder to the point where another rod attached parallel and attached to the shank extending down the shaft towards the head of the shaft ending at a point from the head of the shaft the length of one of the slots less the diameter of the shaft. Upon pulling back on the rod that tipped the shaft perpendicular the cylinder is allowed to be pulled back being stopped by the rod opposite the pulling rod, therefore, tipping the slotted cylinder back into a parallel position to the shank where the tool can then be easily removed from the hole it was inserted.

DETAILED INVENTION DESCRIPTION

The invention is described in more detail hereinafter in connection with the accompanying drawings wherein:

FIG. 1 is a side view of the puller with the slotted cylinder in an open position.

FIG. 2 is a side view of the puller rotated 90° from FIG. 1 with the slotted cylinder in a closed position.

FIG. 3 shows the slotted cylinder in a closed position rotated 180° from FIG. 1.

FIG. 4 shows the slotted cylinder in a closed position rotated 270° from FIG. 1.

FIG. 6 shows one of the flat sided surfaces of the cylinder.

FIG. 5 shows an end view of the cylinder in FIG. 6.

FIG. 7 shows the flat surface of the cylinder opposite the flat surface shown in FIG. 6.

FIG. 8 shows an end view of the cylinder of FIG. 7.

FIG. 9 shows the control lever 11.

FIG. 10 shows the auto body dent removing anchor and puller attached to an impacting device or slide hammer.

More thorough description of FIG. 1:

1 is the shank having a rounded head 2 like a common stove bolt. 131 is the modified cylinder shaped object that can be tipped from a perpendicular position. 1 is the shank of a threaded shaft having a half rounded shaped head similar to the head found on a common stove bolt without a slot. 131 is in a perpendicular or open position from the shank 1 and abuts against the material 30 and 31 after being tipped into position by pushing the controlling lever 11 that is attached to 12 the controlling rod that is attached to the cylinder 131 through notch 16 and hole 15 of FIG. 2. 10 is the collar attached to rod 14 and surrounding the shank 1. The purpose of the rod 14 or spline is to stop the cylinder 131 and to aid in the tipping of cylinder 131 back into the parallel position to the shank 1. 17 is a set screw in the collar 10 that holds the collar 10 in a permanent position.

FIG. 2 shows the flat surface 3 of 131 and the cylinder shaped wall 9 of 131 and the angled rounded end 5 of 131 and the rounded opposite end 6 of 131. Also FIG. 10 the lever is shown in the drawn back position on the shank.

FIG. 3 shows the auto body dent removing anchor and puller rotated in 180° from FIG. 1 in the parallel position from the shank and the dotted lines 133 show the cylinder in a partially opened position and the dotted lines 132 in a fully opened position. Also 5 of 131 is the angled rounded shaped end for the purpose in aiding of the tipping of the cylinder.

FIG. 4 shows the auto body dent removing anchor and puiler rotated in a 270° angle from FIG. 1. FIG. 4 also shows the rod 14 stopping the cylinder 131 and allowing it to be tipped into a parallel position to the shank.

FIG. 6 shows the cyllinder with one of the flat V-shaped surface 4 shown and the slot 8 in the cylinder and the cylinder shaped wall 9 and the hole 35 drilled perpendicularly through the cylinder 131.

FIG. 5 is an end view of the cylinder in FIG. 6 showing the longitudinal bore in the cylinder 131 and a better view of 16 the slot which the controlling rod rides in and 4 the V-shaped flat surface of the cylinder.

FIG. 7 shows the opposite side of the cylinder in FIG. 6 and the V-shaped flat surface of that side 3 and the slotted portion 7 of the cylinder.

FIG. 8 shows an end view of FIG. 7 and an end view of the flat V-shaped surface 4.

FIG. 9 shows the controlling rod and lever separately with the dotted lines 19 indicating a hole in the lever allowing the lever to slide up and down on the shaft 1. 12 the controlling rod having a loop 20 that is attached to the cylinder 131 through hole and slot 15 and 16.

FIG. 10 shows the auto body dent removing anchor and puller and the cylinder 131 in the closed position and the dotted lines 132 indicate the cylinder in the open position. 22 is a collar attaching the shank of the auto body dent removing anchor and puller to the shank 23 of an impacting device that uses a hammering action of 24 a heavy cylinder shaped object that slides on shaft 23 and when 24 is drawn back with force stopping at handle 25 creating an impacting action thus pulling out the damaged area.

I claim:

1. A dent pulling tool comprising:

(a) an elongated shank having a head at one end larger than the diameter of said shank, wherein the other end of said shank is adapted to be attached to handle means;

(b) a cylinder mounted on said shank, said cylinder having an opening extending therethrough from one end of said cylinder to the other end, said cylinder having slots extending from opposite ends on opposite sides thereof in a manner and at a depth such that a transverse opening is defined which extends transversely through said cylinder; wherein said shank extends through said cylinder and said slots are dimensioned to receive said shank when said cylinder is oriented parallel to said shank; and wherein said transverse opening is sufficiently large to enable said cylinder to be tilted perpendicular to said shank, (c) a lever slidably mounted on said shank between an outward position and an inward position, (d) a first rod connected at one end to said lever and at its other end to said cylinder, (e) a second rod secured to said shank, wherein said cylinder is pivoted from a first position parallel to said shank to a second position perpendicular to said shank by means of said first rod when said lever is moved from its outward position to its inward position, and wherein said cylinder is pivoted from its said perpendicular position to its said parallel position by means of one end of said cylinder being urged against said second rod when said lever is moved to its outward position.

2. A dent pulling tool in accordance with claim 1, wherein said slots on said opposite sides of said cylinder define surfaces which are parallel to each other.

3. A dent pulling tool in accordance with claim 1, wherein the end of said shank opposite said head is threaded.

4. A dent pulling tool in accordance with claim 1, further comprising handle means threadably engaging said shank.

5. A dent pulling-tool in accordance with claim 1, wherein second rod is secured to the opposite side of said shank from said first rod.

6. A dent pulling tool in accordance with claim 1, wherein said second rod is parallel to said shank and extends from a point approximately half the length of said cylinder away from said head of said shank at least to the point of said outward position of said lever, wherein said lever includes a groove which is adapted to slidably receive said second rod when said lever is moved from its outward position to its inward position.

7. A dent pulling tool in accordance with claim 1, wherein said cylinder includes a longitudinal groove along the inner surface thereof from approximately the middle of said cylinder to one end thereof, wherein said groove is adapted to receive said first rod when said lever is in said outward position.

* * * * *